US005421561A

United States Patent [19]

Eisermann et al.

[11] Patent Number: 5,421,561

[45] Date of Patent: Jun. 6, 1995

[54] GAS STIR DEVICES WITH REFRACTORY MATERIAL EROSION DEPTH INDICATOR AND METHOD OF MAKING THE SAME

[75] Inventors: Eckehard Eisermann, Vermillion; Robert J. Mascara, Canfield, both of Ohio

[73] Assignee: Martin & Pagenstecher, Inc., North Olmsted, Ohio

[21] Appl. No.: 153,019

[22] Filed: Nov. 15, 1993

[51] Int. Cl.[6] ..... B22D 41/58

[52] U.S. Cl. ..... 266/100; 266/220

[58] Field of Search ..... 266/100, 220, 216, 217

[56] References Cited

U.S. PATENT DOCUMENTS

| | | | |
|---|---|---|---|
| 4,744,544 | 5/1988 | LaBate et al. | 266/100 |
| 5,202,079 | 4/1993 | Winkelmann et al. | 266/100 |
| 5,249,778 | 10/1993 | Steichert et al. | 266/220 |

*Primary Examiner*—Scott Kastler
*Attorney, Agent, or Firm*—Caesar, Rivise, Bernstein, Cohen & Pokotilow, Ltd.

[57] ABSTRACT

A device, e.g., a stirring plug or a mono-block stirring plug and pocket block set, for introducing gas into a mass of molten metal. The devices each have a body formed of a first refractory material. The stirring plug has plural V-shaped, gas carrying slots extending therethrough, while the mono-block set includes plural helical passageways extending therethrough. A wear indicator comprising a thin walled, thermally insulative tube having a central core of a second refractory material of a different coefficient of light emission but similar coefficient of thermal expansion to the first material is disposed within a central recess in the body adjacent either the top or the bottom end of the device. The wear indicator extends towards an intermediate point representing the remnant height of the device. In one embodiment the wear indicator is in the top of the device so that the refractory material making up the central core is visually distinguishable from the material making up the body so that when the upper end of the central core is exposed by the erosion of the device it provides a visual indication that the device should be replaced.

18 Claims, 4 Drawing Sheets

FIG.5
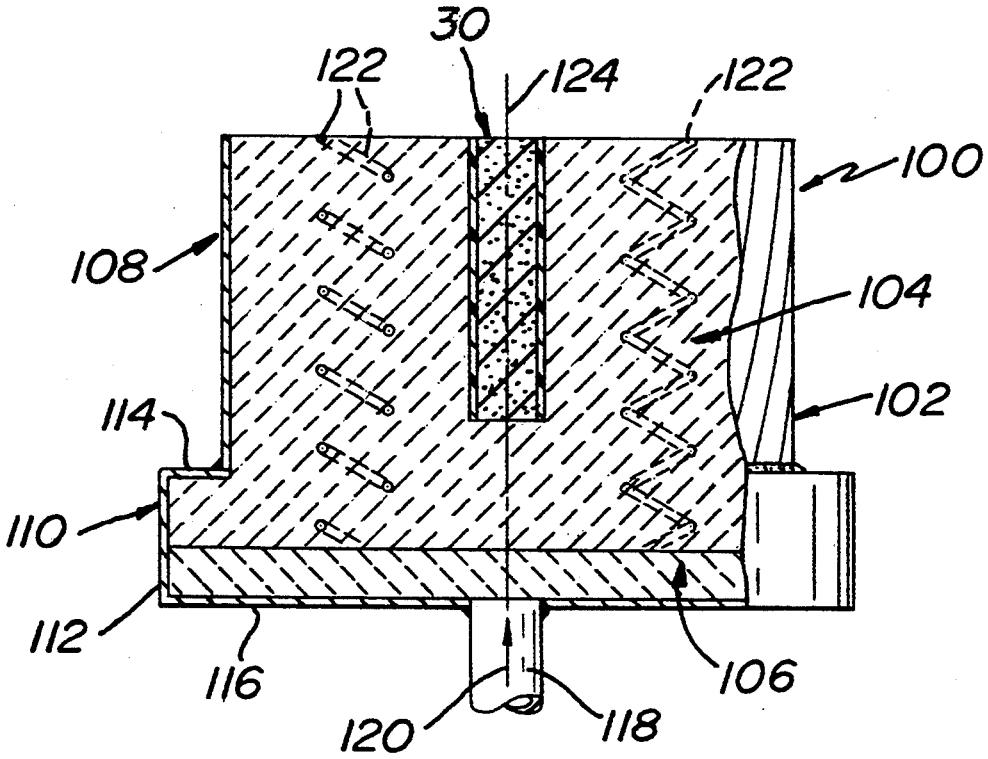
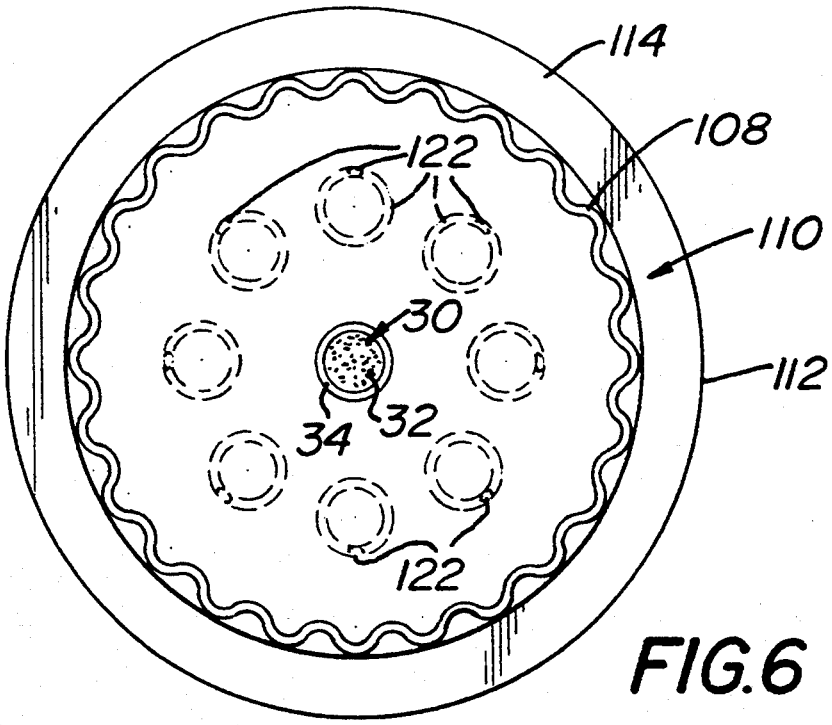
FIG.6

FIG. 7
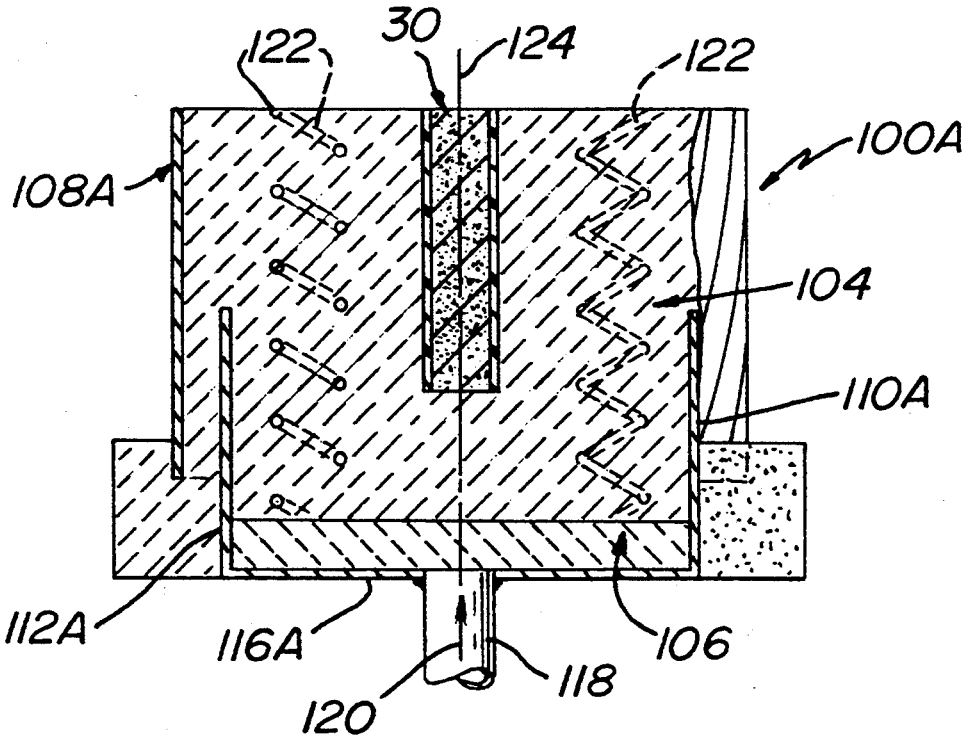
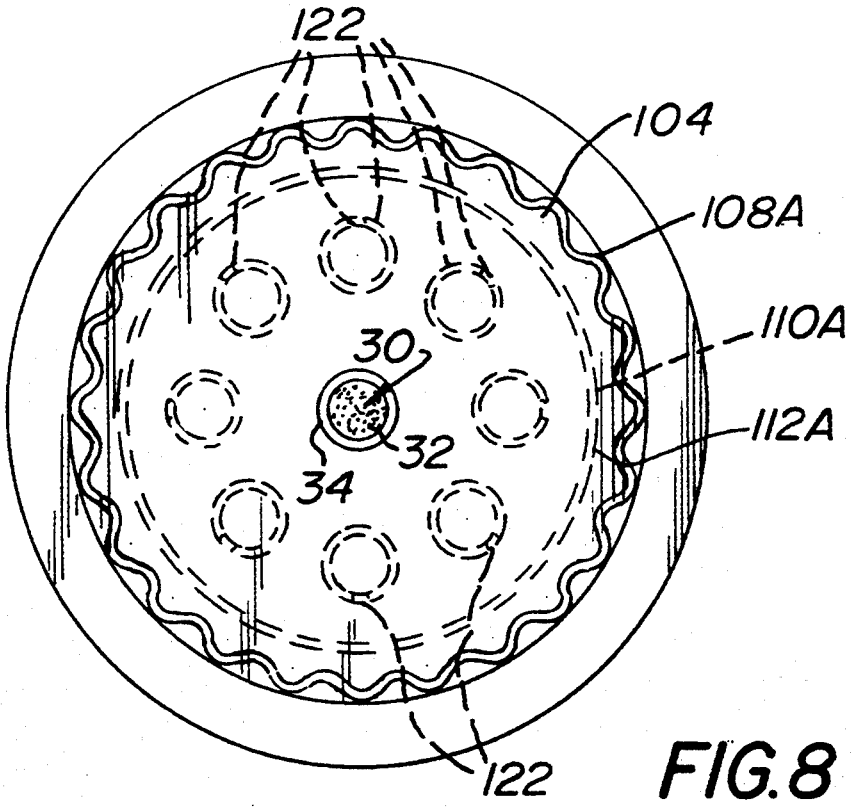
FIG. 8

GAS STIR DEVICES WITH REFRACTORY MATERIAL EROSION DEPTH INDICATOR AND METHOD OF MAKING THE SAME

BACKGROUND OF THE INVENTION

This invention relates generally to devices for insufflating gas into a mass of molten metal such as steel, and more specifically, to an optical wear indicator that indicates when the device should be replaced.

The making of steel or other metals typically involves the introduction of gases into the ladle or vessel holding the molten metal to stir it. The gas is typically introduced into the ladle via a device called a stir plug. Such a stir plug may be mounted in the bottom or side of the vessel. Prior art stir plugs have taken numerous forms and constructions.

For example, one common type of stir plug comprises a solid, non-gas-permeable, conical refractory member disposed within a loose fitting metal or ceramic shell or canister. Such a "canistered" plug is commonly disposed within a seating block in the wall, e.g., the bottom, of the vessel holding the molten metal, and the purging gas is transported through the gap between the refractory cone and the metal canister into the molten metal.

Any refractory material stir plug device is subject to wear due to extreme operating conditions. As the stir plug is worn down, the longitudinal height of the plug decreases. Stir plugs must be replaced as soon as a certain critical minimal or remnant height is reached. If the stir plug is permitted to erode too much before it is replaced, a burn-out of the ladle in which the stir plug is located might occur, which is not only dangerous, but costly to replace.

Stir plugs with various devices to facilitate the determination of the critical remnant height have been generally available, but with certain tradeoffs. For example, electrical indicators are generally available, but they may be expensive to install and maintain, they require an external recording apparatus and are a possible source of disturbance in an already error sensitive system.

One type of electrical indicator is the device described in the U.S. Pat. No. 4,481,809 (LaBate) which utilizes several Hall effect transducers and circuitry to monitor the output thereof.

Another electrical indicator is that disclosed in German Patent No. DE 3,424,466 (Grabner) which utilizes two electrical wires within a probe. Both ends of the wires at the tip of the probe are separated. The wires consist of an alloy that melts at the critical temperature which indicates the critical wear height. The melting alloy closes the circuit and allows an electrical current to flow from the power source.

Temperature indicators are also available, but suffer from similar drawbacks as do the electrical indicators. One such device is the one disclosed in German Patent No. DE 3,526,391 (Fischer) which utilizes a thermocouple located inside the body of a ceramic stir plug. The critical temperature inside the plug is measured to determine the critical wear height of the plug. One deficiency of this device, however, is that in the event the temperature of the liquid metal destroys the thermocouple, the temperature can no longer be measured and therefore the plug may have to be prematurely replaced.

Other prior art devices measure thermal conductivity to provide an indication of the lifetime of a stir plug. For example, German Patent No. DE 3,833,503 (Rothfuss) discloses a valve configuration inside a ceramic gas stir plug. A low melting alloy keeps the gas flow valve control in the open position. Concurrent with the erosion of the stir plug, high temperatures will ultimately cause the alloy component to melt. This causes the gas flow valve to close, thus either reducing or eliminating gas flow. The reduced or discontinued gas flow indicates the stir plug wear.

Another device disclosed in German Patent No. DE 3,623,609 (Rothfuss) uses a gas flow restriction as a wear indicator. However, a gas flow restriction is not an unmistakable criterion, because a premature steel penetration of the gas passageways result in a low gas flow, thus causing a premature replacement of the stir plug.

German Patent No. DE 3,802,657 (Winkelmann) discloses a refractory wear indicator incorporated in a gas stir plug. This device is an optical indicator which makes use of the geometrical arrangement of the gas passageways situated inside the plug. A certain configuration of gas passageways inside the refractory cone separates the inner refractory portion from the outer one. The inner portion includes a round cross section at the tip of the stir cone. The round cross section changes into a square one at the bottom of the refractory cone. In use, when the metal has been tapped from the ladle and the stir plug is hooked up to a natural gas purging line, the natural gas escapes in a circle configuration from the plug. If the plug is worn down below the critical height, the configuration of the natural gas flames changes from round to square. This indicator system can only work as long as the gas passageways are free from steel. Steel penetration of the passageways prevents gas flow, thus rendering the passageways invisible.

U.S. Pat. No. 4,744,544 (LaBate et al.) describes a visual wear indicator for a metallurgical vessel that uses a metal rod which is inserted in the upper portion of a refractory body and extends inwardly of the surface of the body, at a length less than the known thickness of the refractory body. In this device, the metal rod and the refractory material therearound are elevated to the same temperature by the molten metal, but their light emission coefficients will be different, whereupon the end of the rod will glow red hot while the surrounding refractory material exhibits a different color (appearance). Thus, one can determine if the cone has worn down beyond the length of the rod. While this wear indicator is generally suitable for its intended purposes, it still leaves much to be desired. In this regard, since the refractory plug and the steel rod of the LaBate et al. patent have different thermal expansion coefficients, elevated temperatures will result in different expansions of both materials, which action may crack the refractory body. Moreover, a faster wear of the refractory body may occur, in part, caused by the drilling of the hole to accommodate the metal indicator. Further, the metal rod may be blown out of its hole by high gas pressure or it may prematurely melt away, thus effecting a premature plug exchange.

In U.S. patent application Ser. No. 08/059,403, filed on May 11, 1993, entitled Gas Stir Plug Wear Indicator Including Low Melting Point Component there is disclosed an claimed a stirring plug which provides more resistance to cracking and degradation than the LaBate et al. U.S. Pat. No. 4,744,544. That gas stirring plug comprises a shell, a core, and a low melting point component disposed within a cavity in the core. The core is located within the shell and is comprised of a refractory material extending between the bottom end and the top end of the plug. The cavity is of a predetermined height and has a bottom located a first predetermined distance above the bottom end of the plug. The cavity is filled with the low melting point component, e.g., soapstone, calcium silicate, talcum, or some other material having a melting point lower than steel, from its bottom to an intermediate point located a predetermined height above the bottom of the cavity. Mortar or some other high melting point refractory component is disposed in the cavity from the intermediate point to the top of the plug. The plug is operative so that when it has worn away to the intermediate point, e.g., the remnant height point, the low melting point component will be exposed to the molten metal, whereupon it will melt and flow out the cavity and molten metal and/or slag will flow therein to provide a predetermined visual appearance, e.g., a glowing dot surrounded by a darker area. That predetermined visual appearance changes, e.g., the glowing dot disappears, when the plug has worn away to the bottom of the cavity, thereby indicating that it should be replaced.

While the stirring plug of the patent application Ser. No. 08/059,403 provides more resistance to cracking and plug degradation than the aforementioned LaBate et al. patent, it never the less still leaves something to be desired from those standpoints. In this regard that stirring plug may also be susceptible to premature cracking under some conditions after the low melting point material has melted away and has been replaced by the metal and/or slag, due to the differences in the thermal expansion coefficients of the metal and/or slag and the refractory material making up the plug.

In German Offenlegungsschrift DE 3142989 there is disclosed several embodiments of a stirring plug formed of a porous refractory material body including a visual wear indicator embedded at the bottom of the refractory body. The visual wear indicator is formed of a refractory material having different light emission characteristic than that of the porous body so that when the plug has worn to its remnant height the wear indicator is exposed. The difference in light emission from the body and the wear indicator provides an indication of when to replace the plug.

In U.S. patent application Ser. No. 07/868,598 filed on Apr. 14, 1992, and entitled Gas Stir Plug With Visual Wear Indicator, there is disclosed a stir plug with a visual wear indicator which overcomes some disadvantages of prior art stir plugs. The stir plug of that application basically comprises a frusto-conical shaped member for introducing gas into a mass of molten metal. The plug has an outer core or body formed of a first refractory material and is located within a metal shell. Plural gas carrying slots may be provided in the body. A wear indicator in the form of a central core comprised of a second refractory material of higher porosity than the refractory material of the body is located within a centrally located recess in the body adjacent the bottom end of the plug. The central core extends from the bottom end of the plug towards the top end of the plug and is of a predetermined height less than that of the outer core. The upper end of the central core when exposed by the erosion of the stirring plug enables gas to flow therethrough so that it is cooler than the body, whereupon its light emission characteristic will be different than that of the body to provide a visual indication that the plug should be replaced.

While the stirring plug of the patent application Ser. No. 07/868,598 is generally suitable for its intended purposes since the wear indicator is located at the bottom of the plug and is of higher porosity than the refractory material making up the plug if the plug is left in operation after it has eroded substantially below the remnant height molten metal breach through the wear indicator.

OBJECTS OF THE INVENTION

Accordingly, it is a general object of this invention to provide a gas stir plug with a wear indicator which overcomes the disadvantages of the prior art.

It is a further object of this invention to provide a gas stir plug with a visual wear indicator which is effective in operation.

It is yet a further object of this invention to provide a gas stir plug device with a visual wear indicator which is reliable.

It is still a further object of this invention to provide a gas stir plug with a visual wear indicator which is simple in construction.

It is still a further object of this invention to provide a gas stir plug with a visual wear indicator which can be manufactured easily and inexpensively.

SUMMARY OF THE INVENTION

These and other objects of this invention are achieved by providing a device, e.g., a plug, for introducing gas into a mass of molten metal and which device is worn away during use. The device has a central longitudinal axis and comprises a top end, a bottom end, an outer body comprised of a first refractory material extending between the bottom end and the top end.

In accordance with one aspect of the device of this invention it includes a visual wear indicator. The wear indicator comprises an elongated tube located within the outer body adjacent one end and centered on the longitudinal axis, and a central core located within the tube. The central core is formed of a second refractory material which is visually distinguishable from the first refractory material of the central core.

In a preferred embodiment the wear indicator is located at the top end of the device, with the core and tube extending downward to a predetermined point establishing the remnant height of the device. In this embodiment the central core is arranged to be exposed, to be visible, when the device has worn away to the predetermined point to provide a visual indication that the device should be replaced.

In an alternative embodiment the wear indicator is located at the bottom end of the device, with the core and tube extending upward to a predetermined point establishing the remnant height of the device. In this embodiment the central core is exposed until the device has worn away to the predetermined point, at which time the central core is no longer visible, to provide a visual indication that the device should be replaced.

In accordance with another aspect of the device of this invention the device comprises a plug of generally frusto-conical shape having a central axis, a top end, a bottom end, and a conical outer surface located between the top end and the bottom end and extends about a central longitudinal axis of the plug. The plug is formed of a refractory material having slots therein.

Each of the slots is a generally linear passageway having a respective longitudinal axis extending the height of the slot between the bottom end and the top end of the plug and at an acute angle to the central longitudinal axis so that the slots are in a frustum array. Moreover, each of the slots is of a generally V-shaped cross sectional area in planes perpendicular to the central longitudinal axis.

In accordance with another aspect of this invention there is provided mono-block devices or units for introducing stirring gas into a mass of molten metal. The devices comprise first hollow member which is tubular and has a central axis and a first sidewall extending about that axis, and a second hollow member including a bottom wall and a second sidewall extending about the axis. The bottom wall of the second hollow member is fixedly secured to the side wall of that member and includes a gas inlet port. A layer of a first refractory material is located within the second member contiguous the said bottom wall, with that refractory material being porous to the passage of a stirring gas therethrough to form a guard plate. A body of a second refractory material is located within the interior of the first hollow member and includes a flanged portion located below the first hollow tubular member and extends outward beyond the periphery of the first hollow tubular member. The body has a top surface and a bottom surface in contact with the layer of said the first refractory material. The body also includes a plurality of gas carrying passageways formed therein and extending from the bottom surface to the top surface.

In one preferred embodiment of the mono-block device the first and second hollow members are secured together to form a canister into which the refractory material forming the body can be poured to form the body without the use of any molds. In another preferred embodiment of the mono-block device the first and second members are separated and are placed within a mold to form the body of the device.

In accordance with one method aspect of this invention a device for introducing a stirring gas into a vessel is made by forming a body of a first refractory material so that the body has a top end, a bottom end, and a central longitudinal axis having a hole extending along a portion of the axis from one of the ends. A wear indicator is disposed within the hole in the device. The wear indicator comprises an elongated tube filled with a second refractory material, e.g., silicon carbide, pure magnesite, high alumina and/or other non-metallic oxides. The second refractory material is visually distinguishable from the refractory material of the body.

In accordance with another method aspect of this invention a device for introducing a stirring gas into a mass of molten metal is made. That device comprises a plug of a generally frusto-conical shape having a central axis, a top end, and a bottom end and is formed of a refractory material having plural slots therein arranged in a frustum array for carrying gas therethrough between the bottom end and the top end of the device. Each of the slots is a generally linear passageway having a respective longitudinal axis extending at an angle to the central axis and each is of a generally-shaped cross-sectional area in a plane perpendicular to that axis. The method of making the device comprises providing a hollow body of frusto-conical shape, inserting plural tapes having a V-shaped cross-section into the hollow body in a frustum array, filling the hollow body with a refractory castable material mix, allowing the material mix to air set, exposing the body with the castable mix and the bands therein to an elevated temperature to cause the mix to form a dense ceramic body and removing the tapes from the ceramic body to form the slots.

BRIEF DESCRIPTION OF THE DRAWINGS

Other objects and many attendant features of this invention will become readily appreciated as the same becomes better understood by reference to the following detailed description when considered in connection with the accompanying drawing wherein:

FIG. 5 is a vertical sectional view of a mono-block gas stir set constructed in accordance with another aspect of this invention;

FIG. 6 is a top plan view of the mono-block gas stir set shown in FIG. 5;

FIG. 7 is a vertical sectional view of an alternative monoblock gas stir set constructed in accordance with another aspect of this invention; and FIG. 8 is a top plan view of the mono-block gas stir set shown in FIG. 7.

DETAILED DESCRIPTION OF THE PREFERRED EMBODIMENTS

Figure 1:
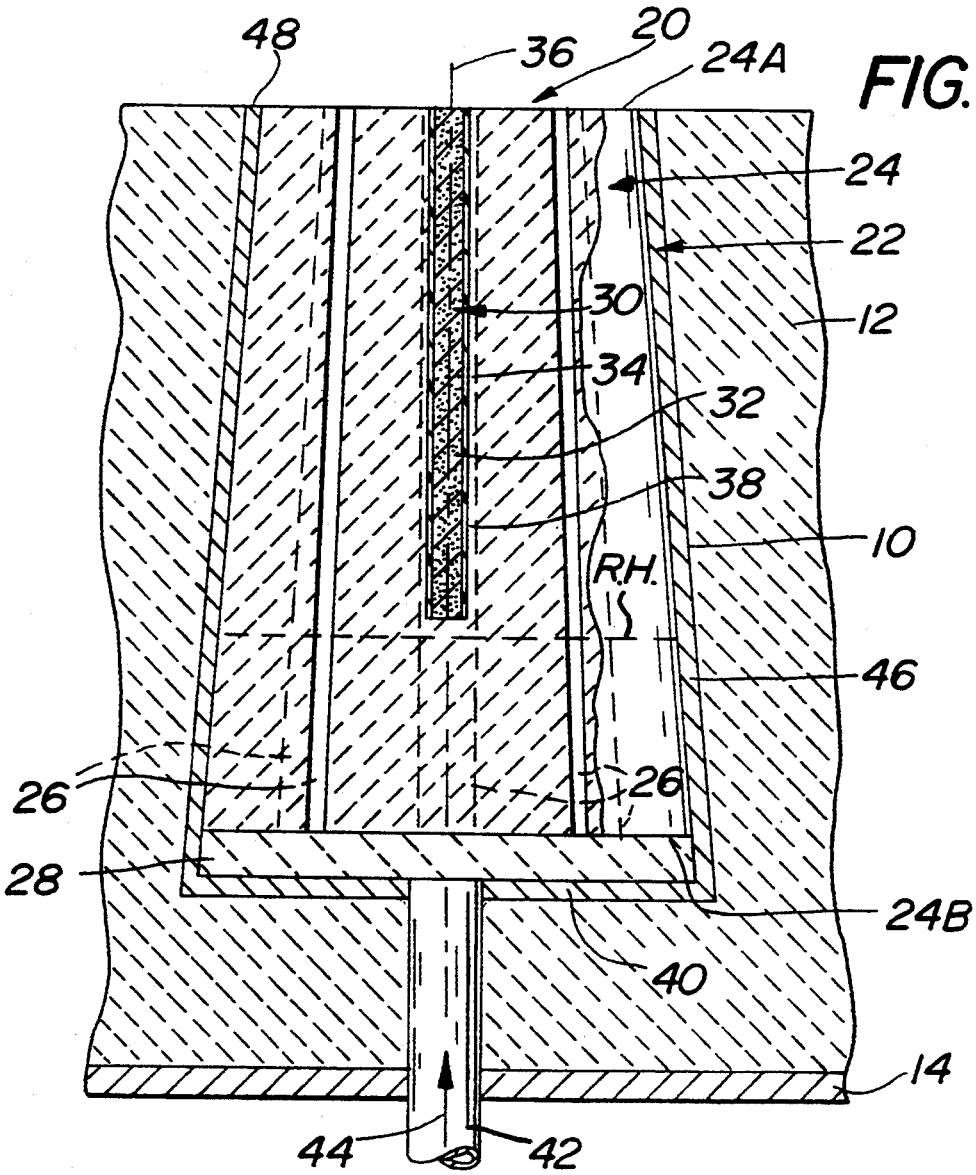
FIG. 1 is a vertical sectional view of a stirring plug constructed in accordance with this invention shown located within a refractory lining of a steel making vessel.

Referring now to various figures of the drawing where like reference numerals refer to like parts, there is shown in FIG. 1, one embodiment of a stirring plug 20 constructed in accordance with this invention. The stirring plug 20 is arranged to be located basically comprises a frusto-conically shaped shell 22 having a frusto-conically core or body 24 located therein. The stirring plug 20 is arranged to be located within a correspondingly shaped recess 10 in a pocket block 12 forming a portion of a refractory lining of a metallurgical vessel 14, e.g., a steel making vessel.

The body 24 of the stirring plug is formed of any conventional dense, non-permeable ceramic or other refractory material, e.g., 95% $Al_2O_3$, 80–95% magnesite (MgO), spinel (aluminum and magnesite), etc. The plug's body can be pressed and fired, cast, rammed, or manufactured in any other suitable manner in any desirable size.

A plurality of passageways or slots 26 extend through the body 24 for transporting a stirring gas through the plug from its bottom end or surface 24B to its top end or surface 24A, as will be described later. A gas distribution, guard plate 28 in the form of a disk formed of a high grade, highly porous, wear resistant refractory material, e.g., $Al_2O_3$ plus other conventional components, is located at the bottom of the body 24. The porous, high grade refractory material of the plate 28 enables the stirring gas to be passed therethrough from a port (to be described later) in the shell 22 and into the passageways 26 (in a manner to be described later), while preventing any molten metal, e.g., steel, from leaking out of the slots by freezing off the molten metal therein. This action effectively prevents steel burn-out through the bottom of the plug.

A visual wear indicator 30 in the form of another refractory material 32, e.g., silicon carbide, pure magnesite, high alumina and/or other non-metallic oxides, in an elongated tube 34 is located within the stir plug body 24 and extends along a portion of its central longitudinal axis 36. As can be seen clearly in FIGS. 1–3 the tube 34 is thin-walled and is preferably formed of a non-metallic, thermally insulative, material, e.g., a plastic, cardboard or a similar material (for reasons to be described later).

The wear indicator 30 may be constructed by inserting the tube 34 within a correspondingly shaped preformed bore in the body 24 of the plug. The refractory material making up the core 32 can be in rammed or cast within the tube. Alternatively, the wear indicator can be pre-manufactured, preferably of by pressing and firing it. The wear indicator can then be installed in the preformed bore in the body of the plug and held in place by a refractory mortar.

The refractory material making up the core 32 of the wear indicator 30 is preferably formulated to have a substantially different light emission coefficient than the refractory material making up the core or body 24, yet have a similar thermal coefficient of expansion (for reasons also to be described later).

In accordance with a preferred embodiment of the invention the wear indicator 30, is preferably located within a correspondingly sized and shaped hole 38 in the upper portion of body 24. The hole can be of any suitable size, e.g., from ¼ inch (0.64 cm) to 1 inch (2.54 cm) in diameter, and from 5 inches (12.7 cm) to 20 inches (50.8 cm) deep, depending upon the size of the stirring plug, and can either be drilled in or formed during the manufacturing process. In any case the hole 38 is centered along the central longitudinal axis 36 of the plug 20 and extends downward from the top surface 24A of the plug 20 a sufficient distance so that its lower end is located adjacent a predetermined point "RH" on the plug near the bottom end thereof. That predetermined point represents the height at which the plug will be allow to erode to before it should be replaced with a new plug and will be hereinafter referred to as the "remnant height" of the plug.

Before describing and discussing the details of the structure and operation of the wear indicator 30 a brief description of the other components making up the stirring plug is in order. To that end, the shell 22 is preferably formed of any suitable material, such as stainless steel, a fired ceramic or a ceramic coated metal. The shell includes a generally planar bottom wall 40 having an inlet port or conduit 42, into which any suitable stirring gas may be introduced in the direction of the arrow 44, and a peripherally extending conical side wall 46 terminating at its upper end in an opening 48. The stirring gas introduced into the port 42 flows through the gas distributing guard plate 28 into the bottom end of the slots 26.

The core or body 24 is shaped to closely fit within the interior of the shell 22. The sidewall 46 of the shell may extend only partially, e.g., from one third to one half (not shown), the height of the body 24 or may extend the full height of the body, as shown. The top and bottom surfaces 24A and 24B, respectively, of the plug are each substantially planar and are disposed perpendicularly to the central longitudinal axis 36.

Figure 2:
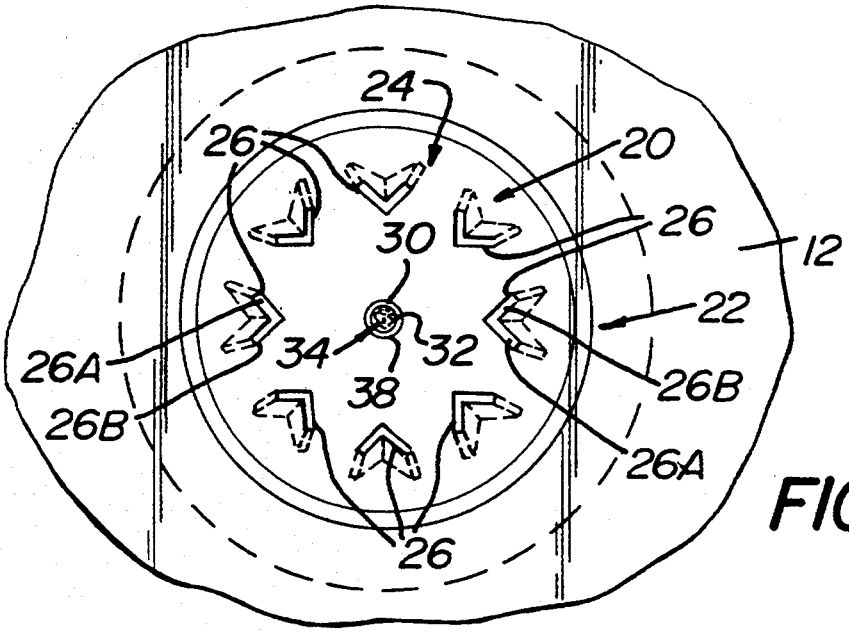
FIG. 2 is a top plan view of the stirring plug and refractory lining shown in FIG. 1.
Figure 3:
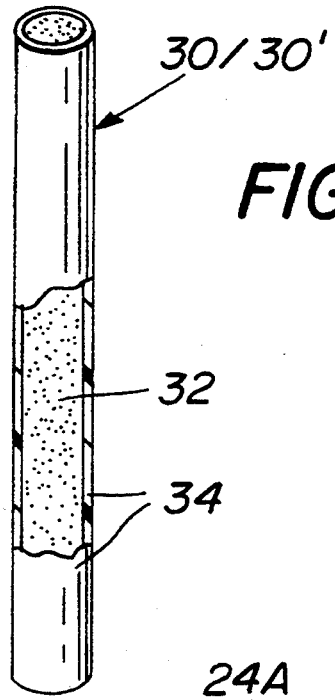
FIG. 3 is an enlarged, isometric view of the wear indicator utilized in the stirring plug of FIG. 1.

As can be seen in FIGS. 1 and 2, there are eight slots 26 in the body 24. The slots 26 are formed in the body 24 using the teachings of U.S. Pat. No. 5,104,097, whose disclosure is incorporated by reference herein. However, unlike the shape of the slots of that patent, the slots 26 of the plug of this invention of are preferably of a V-shaped cross-section, as shown clearly in FIGS. 2 and 4, so that each slot includes a pair of rectangularly shaped leg sections 26A and 26B. The thickness of each of the rectangular leg sections is less than the thickness of each rectangular slot in the 5,104,097 patent. The V-shaped slots 26 enable more free gas flow therethrough than the rectangularly shaped slots of 5,104,097 patent and without compromising structural integrity of the plug's body. Moreover, since the V-shaped slots are effectively thinner than rectangular shaped slots the use of V-shaped slots decreases the likelihood of molten metal penetration through them. Further still, since the slots 26 are V-shaped, they can be formed quite readily, as will be described later.

The V-shaped slots 26 can be oriented and disposed within the body 24 so that their longitudinal axis is parallel to the central longitudinal axis of the device (not shown). Preferably, however, they are disposed and oriented so that their longitudinal axis is at an acute angle to the central longitudinal axis of the device, whereupon the slots are in a frustum-shaped array about the central longitudinal axis 36. In any case, the slots serve to carry the stirring gas introduced into their lower ends out through the top end of the plug to stir molten metal in the vessel 14 in which the stirring plug 20 is located. Irrespective of the shape of the slots, their number, and/or manner of formation, the walls forming the periphery of the slots are smooth so that each slot can transport gas therethrough with low frictional loss from the bottom of the plug to its top. Moreover, since the slots are of small cross section they minimize the danger of slot blockage caused by the intrusion and freezing of the metal in the slot as the plug wears down should the flow of gas therethrough become interrupted or terminated.

Referring now to FIG. 1, it can be seen that since the bottom of the wear indicator 30 is located just above the critical wear or remnant height RH the material 32 making up the central core of the wear indicator will be visible from a top plan view (like that of FIG. 2) at all times that the plug's height is greater than the remnant height. In particular, when the plug is in use the heat of the steel will raise the temperature of the body 24 and the wear indicator's central core 32, so that the central core 32 when viewed from the top (like in FIG. 2) appears as a dot of a markedly different visual appearance, e.g., color or brightness, than the surrounding body. Depending upon the formulations and concomitant light emission characteristics of the different refractory materials making up the core 32 and body 24, the indicator core 32 may appear lighter or brighter in color than the surrounding body 24 or may be darker. In any case the distinctive appearance of the core 32 of one color or brightness surrounded by the body 24 of a contrasting color or brightness provides a ready indication to workers that the plug is still of a viable length. When, however, the plug has eroded to the point just below the bottom of the wear indicator, i.e., to the "remnant height" there will be no wear indicator left. Accordingly, when the plug 20 is viewed from the top it will appear as a uniform color or brightness, i.e., the color of the body 24, across its entire visible surface.

This indicates that the plug should be taken out of service and replaced by a new plug 20.

As will be appreciated by those skilled in the art the thin, non-metallic, tube 34 of the wear indicator 30 provides thermal insulation between the refractory material 32 of the wear indicator 30 and the surrounding refractory material, i.e., the refractory material of the body 24. The effect of such insulation may result in the enhancement of the difference in light emission between the wear indicator and the surrounding refractory body, making visual identification of the need to replace the plug that much easier, while preventing cracking due to any difference in expansion between the core 32 and the body 24 if they do not exhibit the same thermal coefficient of expansion.

Figure 4:
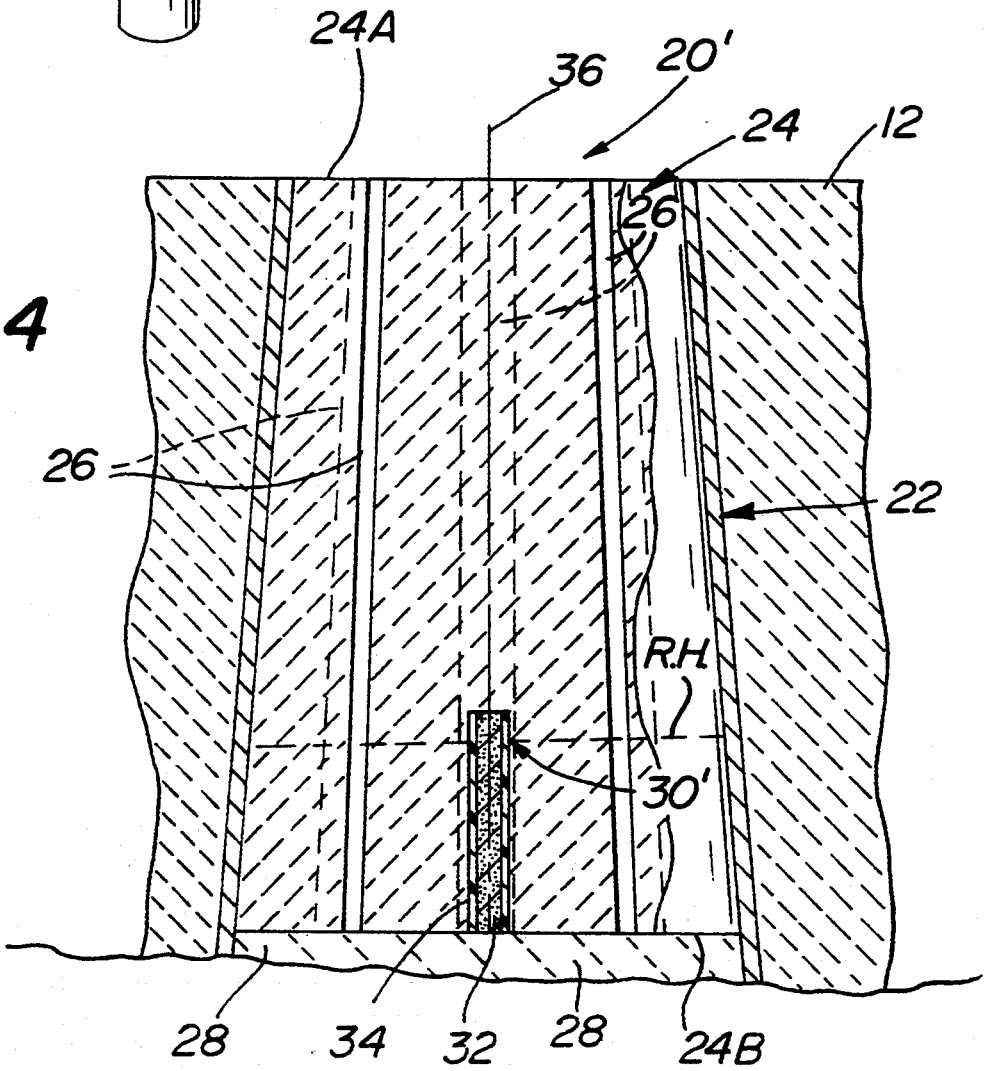
FIG. 4 is a vertical sectional view, similar to FIG. 1, but showing an alternative embodiment of the stirring plug of this invention.

Referring now to FIG. 4 alternative embodiment 20' of the stir plug of this invention will now be described. That plug is identical in construction to the plug 20 except for the location of the wear indicator. In particular, the wear indicator 30' of the plug 20' is located at the bottom of the plug 20' and extends upward so that its upper end is located just above the remnant height RH of the plug. Thus, when the height of the stirring plug 20' is sufficient so that it need not be replaced, i.e., the plug has not eroded to its remnant height, the appearance of the plug's top surface 24A (as viewed from the top) will be uniform, i.e., the color of the body 24, since the wear indicator 30' will not be exposed at that time. However, when the plug 20' has eroded to the point at which its top surface 24A is at the height of the top of the wear indicator 30' the material 32 making up the central core of the wear indicator will become exposed and visible, e.g., a lighter colored or brighter dot surrounded by a darker body (depending upon the formulations of the refractory materials making up the core 32 and the surrounding body 24). This distinctive appearance can be readily perceived by operating personnel, to indicate that the plug should be replaced.

As should be appreciated from the foregoing by making a wear indicator of a refractory material formulation having a substantially different light emission coefficient than the refractory material of the stirring plug, but of a similar thermal expansion coefficient, one is able to provide a readily perceivable visual indication of when the stirring plug has reached its remnant height. This desirable action is achieved without the problems of plug cracking or premature wear, etc., such as occurs with plugs using steel rod wear indicators (like the aforementioned LaBate et al. patent), which result from the markedly different thermal coefficients of expansion of steel and refractory materials and/or the corrosive steel/slag attacks at the holes containing the steel rods.

The plugs 20 and 20' are preferably made as a one-piece construction in accordance with the following method, which in many ways is similar to that disclosed in U.S. Pat. No. 5,104,097. To that end, a hollow body or mold (not shown) is provided. The mold includes a cavity of frusto-conical shape having walls configured and shaped to produce the frusto-conical body 24. A plurality of elongated, linear, hardened steel tapes (not shown), each of a generally V-shaped cross section are positioned in the mold cavity in a frusto-conical arrangement to form the slots 26. Each tape is of the appropriate size and cross sectional shape for forming each V-shaped slot 26. Preferably, each of the tapes includes a release agent, e.g., a low melting point wax, oil, grease, etc., thereon. Once the coated tapes are in position within the mold cavity, a ceramic compound or mix for making up the body 24 is introduced and packed around the tapes. The compound is allowed to set and thereafter modest heat, e.g., approximately 100 degree Celsius, is applied so that the release coating on the tapes melts and leaves a space in the mix. The tapes can then be pulled out of the mix from the bottom of the plug body at ambient temperature with almost no friction. This action forms the slots within the plug body without disturbing the mix making up that body. The plug body is then ready to be baked, as is conventional, to make it ceramic.

As should be appreciated by those skilled in the art, when the slots 26 are formed using the metal strip method disclosed above, the V-shaped strips or tapes of metal can be thinner than the flat tapes used in the 5,104,097 patent to form the rectangular slots, yet have sufficient tensile strength to enable them to be pulled out of the plug's body to form the passageways without snapping or otherwise breaking off. In order to facilitate the removal of the tapes from the mix making up the body of the plug the tapes are preferably tapered, that is they are constructed so that their legs (i.e., their portions forming the legs 26A and 26B of the slots) decrease in length from the bottom of the plug to the top of the plug. Thus, when the tapes are pulled out of the plug from the bottom of the plug they form flared slots, and the tapes readily clear these slots upon being extracted therefrom.

It must be pointed out at this juncture that the specific refractory materials used to form the wear indicator core and the surrounding body are merely exemplary. Thus, for example, other materials having similar thermal expansion coefficients and different light emission coefficients can be used. Moreover, while the foregoing description of the invention has been in the context of a stirring plug, the wear indicator aspect of this invention has wider applicability. Thus., the wear indicator of this invention can be used in other refractory structures. For example, the wear indicator can be used in bricks forming a refractory lining in any application wherein that lining may be eroded away to a remnant height, at which time it should be replaced.

In FIG. 5 there is shown a gas stir set 100 constructed in accordance with another aspect of this invention. The gas stir set 100 is arranged for introducing a stirring gas into molten metal, in a similar manner to the stirring plugs 20 and 20'. However, the stir set 100 obviates the need to manufacture a separate stir plug with guard plate in a canister or shell (like the stir plugs 20 and 20') and a separate pocket block 114 for holding the stir plug, by combining those components into one, integral unit. By virtue of its integral construction the stir set 100 of this invention will hereinafter be referred to as a mono-block.

As will be appreciated from the description to follow the mono-block stir set 100, can be manufactured and produced more inexpensively than prior art separate components, without comprising the performance of the gas stir set.

As can be seen clearly in FIG. 5 the mono-block gas stir set 100 basically comprises a metal shell or canister 102 in which a refractory body 104 and a gas distribution guard plate 106 are located. The body 104 comprises any suitable refractory material, e.g., like that forming the body 24 of the stirring plug 20 described heretofore. The method in which the body formed within the canister 102 will be described later. The guard plate 106 is also formed of any suitable refractory material, e.g., like that forming the safety plate 28 described heretofore, and its manner of fabrication and location within the canister will also be described later.

The canister 102 includes a hollow cylindrical upper section 108 and a hollow cylindrical lower section 110. The upper section comprises a length of a metal conduit, e.g., air duct tubing having a helically corrugated thin sidewall. The bottom section 110 is a smooth walled member formed of any suitable material, e.g., metal, having a circular sidewall 112, an inwardly directed upper flange 114 and a generally planar bottom wall 116. The peripheral edge of the flange 114 of the lower section 110 is circular and is secured, e.g., welded, to the abutting peripheral edge of the upper section 108. While the sidewall 112 of the bottom section is shown as being cylindrical, it may be rectangular, square, or any other desired shape.

The bottom wall of the lower section includes an inlet conduit 118, into which any suitable stirring gas may be introduced in the direction of the arrow 120. The guard plate 106 is located within the bottom section on the inner surface of the bottom wall. Accordingly, stirring gas introduced through the conduit 118 will flow through the plate 106. The body 104 is located directly on the guard plate and completely fills the remaining interior of the canister 102 from the guard plate to the top.

A plurality of gas carrying passageways 122 are formed within the body 104, in a manner to be described later. The passageways may be of any suitable shape. In the embodiment shown in FIG. 5 the passageways are helical. Alternatively, they may be V-shaped, like those described heretofore. In fact, the passageways can be of any shape deemed suitable, e.g., the rectangular shaped slots of the 5,104,097 patent. In any case the passageways 122 are spaced equidistantly about the central longitudinal axis 124 of the body. Each of the passageways 122 extends from the bottom of the body to its top to carry gas therethrough. Thus, the stirring gas introduced into the port 118 flows through the gas distributing guard plate 106 into the bottom end of the passageways 112, up through the passageways and out their upper ends.

A visual wear indicator 30 constructed as described with respect to stir plug 20 is located within the body 104 at the upper end thereof and centered on the central longitudinal axis 124. The wear indicator extends down into the body to a point immediately adjacent the remnant height of the mono-block stir set. It should be pointed out at this juncture that while the mono-block gas stir set 100 shown includes a wear indicator 30 located at the upper end thereof, such is not required. Thus, if desired the wear indicator may be located at the bottom of the stir set 100 in a manner like that described with reference to stir plug 20'. In fact, for some applications no wear indicator need be provided in the stir set.

The mono-block stir set 100 is constructed in the following manner: If the refractory guard plate 106 is to be a pre-formed member, it is fabricated by pre-shaping the mix making up the plate, pressing the mix and then firing it to complete the piece. The preformed guard plate is then located within the bottom or lower section 110 of the cannister before that section is completed and welded to the upper section 108. Then the two sections 108 and 110 are welded together. Alternatively, the two sections 108 and 110 can be welded together and a special porous refractory mix poured into the bottom section 110 of the canister.

Irrespective of how the guard plate is made, i.e., whether it is preformed and inserted into the bottom section 110 or poured into the bottom section, once it is in place the high grade refractory mix making up the body 104 is poured therein to completely fill up the interior of the canister 102. However, before pouring the body mix into the canister's interior strips of material for forming the passageways 122 must be inserted into the interior of the canister 102. Thus, strips (e.g., helices, V-shaped, or rectangular shaped, strips) of a low evaporation point material are suspended from the top of the canister down to the top surface of the guard plate 106. Then the high grade refractory mix is poured into the canister to surround the strips. The canister with the refractory mix is then heated to cause the mix to set into a ceramic. The elevated temperature causes the low melting point material of the strips to burn out, thereby forming the passageways 122. If the strips for forming the passageways are make of metal, e.g., such as if the strip's are V-shaped or rectangularly shaped, they are coated with a release material and are withdrawn from the mix after it has air set, and before firing.

As should be appreciated by those skilled in the art, the mono-block units of this invention offer various advantages over prior art assemblies of stir plugs, seating blocks, and safety plates, since the mono-block unit requires no assembly of individual components. Moreover, the mono-blocks can be manufactured inexpensively. For example, the metal casing forming the canister 102 of the mono-block of FIGS. 5 and 6 can be formed of inexpensive carbon sheet metal instead of expensive stainless steel, as have characterized prior art separate stir plugs. Further still, the construction of the mono-block unit is such that it can be fabricated much easier than prior art stir plugs, e.g., it does not require expensive dies to form the refractory body, since that body is merely poured into the canister. This feature also offers the advantage of speed of manufacture, since an unlimited number of mono-block units can be poured into metal canisters or casings at once without having to invest in a large amount of conventional dies (it typically takes approximately four hours to form a refractory body in a conventional die). Another advantage of a mono-block unit is that conventional seating blocks for gas stir plugs have a tendency to crack prematurely during operation, thus forcing a block and plug exchange at least if the crack opens and allows steel penetration. The metal casing or canister 102 of the mono-block unit prevents the block from developing open cracks.

In some applications it may be less expensive to utilize a die to form the mono-block unit than to fabricate the canister 102. In such applications a mono-block unit 100A, like that shown in FIGS. 7 and 8 can be provided in accordance with this invention. The mono-block 100A is slightly different in construction than the mono-block 100. In particular, the mono-block 100A does not make use of a unitary canister 102, like that described earlier, but rather includes two separate members (to be described later). Virtually all other features of the mono-block 100A are the same as the mono-block 100. Thus, in the interest of brevity such common features will be given the same reference numerals and their details will not be reiterated.

As can be seen in FIGS. 7 and 8 the mono-block 100A includes a upper tubular section or member 108A, whose construction is similar to the section 108, except that the length of the section 108A is longer than the comparable section 108 so that its bottom edge extends into the flanged portion of the body 104A. A lower cup-shaped section 110A is provided and includes a bottom wall 116A and a sidewall 112A. The bottom wall 116A is similar to bottom wall 116 except that it is smaller in diameter. A gas passageway 118 is provided in the center of the bottom wall. The sidewall 112A is similar to the sidewall 112 except that it is smaller in diameter and is considerably higher than the sidewall 112. Thus, as can be seen the sidewall 112A extends up and into the portion of the body 104 contained within the upper member sidewall 108A.

The guard plate 106A is similar to the guard plate 106 except that it is smaller in diameter, since it is confined within the smaller diameter sidewall 112A of the bottom member 110A.

The gas passageways 122 and the wear indicator 30 are identical to those components of the mono-block 100 and may take all the variations thereof as discussed earlier.

The mono-block stir set 100A is constructed in the following manner: If the refractory guard plate 106A is to be a pre-formed member, it is fabricated by pre-shaping the mix making up the plate, pressing the mix and then firing it to complete the piece. The preformed guard plate is then located within the cup shaped lower member 110A. Then the cup shaped member 110 with the guard plate material therein is located with the interior of a small, reusable die or mold (not shown) having a sidewall, e.g., circular, square, etc., located beyond the periphery of the sidewall 112A of the lower member. A refractory castable mix is then poured into the mold to form the flanged portion of the body 104. Strips of material for forming the passageways 122 are then inserted into the interior of the cup shaped member 110A so that they extend from the top surface of the guard plate 106A to the top of the hollow member 108A. In particular, strips (e.g., helices, V-shaped, or rectangular shaped, strips) of a low evaporation point material are suspended from the top of the member 108A down to the top surface of the guard plate 106. Then a high grade refractory castable mix is poured into the interior of the member 108A to surround the strips and to merge with the castable material in the mold portion forming the flange of the body 104. The refractory mix is then heated to cause the mix to set into a ceramic. The elevated temperature causes the low melting point material of the strips to burn out, thereby forming the passageways 122. If the strips for forming the passageways are make of metal, e.g., such as if the strip's are V-shaped or rectangularly shaped, they are coated with a release material and are withdrawn from the mix after it has air set, and before firing.

Without further elaboration the foregoing will so fully illustrate our invention that others may, by applying current or future knowledge, adapt the same for use under various conditions of service.

We claim:

1. A device for introducing gas into a mass of molten metal and which is worn away during use, said device having a central longitudinal axis and comprising a top end, a bottom end, a tube, and a body comprised of a first refractory material extending between said bottom end and said top end and having a bore therein extending along said axis from one of said ends to a first intermediate point, said device being arranged to receive said gas adjacent said bottom end and to allow said gas to exit therefrom adjacent its top end, said tube being an elongated preformed, self supporting member located within said bore in said body adjacent one of said ends and extending to said intermediate point within said body, said intermediate point being adjacent the remnant height of said device and centered on said longitudinal axis, and a central core located within said tube and extending the length thereof, said central core being formed of a second refractory material which is visually distinguishable from the refractory material of said body, said central core cooperating with said body to provide a visual indication of when said device has worn away to said remnant height so that said device should be replaced.

2. The device of claim 1 wherein said central core and said tube are located within said body adjacent the top end of said device, with said central core and tube extending downward from said top end to said intermediate point.

3. The device of claim 1 wherein said central core and said tube are located within said body adjacent the bottom end of said device, with said central core and tube extending upward from said bottom end to said intermediate point.

4. The device of claim 1 wherein said first refractory material has a first coefficient of light emission and said second refractory material has a second coefficient of light emission, with said first and second coefficients of light emission being substantially different.

5. The device of claim 4 wherein said first refractory material has a first coefficient of thermal expansion and said second refractory material has a second coefficient of thermal expansion, said coefficients of thermal expansion being substantially the same.

6. The device of claim 1 additionally comprising plural slots therein for carrying gas therethrough between the bottom end and the top end of said device.

7. The device of claim 6 wherein said slots are generally V-shaped in cross-section.

8. The device of claim 1 wherein said tube is formed of a thermally insulative material.

9. The device of claim 1 wherein said second refractory material comprises a dense refractory mix.

10. The device of claim 9 wherein said refractory mix is selected from the group consisting of silicon carbide, pure magnesite, high alumina, and other non-metallic oxides.

11. A visual wear indicator for use in a refractory lining formed of a first refractory material, said lining having a top surface and being subjected to erosion and heat and a bottom surface, said refractory lining having a bore therein communicating with at least one of said top and bottom surfaces, said first refractory material having a first coefficient of light emission, said wear indicator comprising an elongated tube and a second refractory material located within said tube, said second refractory material having a second coefficient of light emission, said elongated tube being preformed, self-supporting, member made up of a thermally insulative material, said tube with said second refractory material therein being located within said bore in said lining closely adjacent one of said top and bottom surfaces and extending said bore to an intermediate point located a predetermined distance below said top surface, said second light emission coefficient being different than said first light emission coefficient, whereupon when said lining is subjected to heat said second refractory material is visually distinguishable from said first refractory material of said wear indicator to provide a visual indication of when the lining has worn away to said predetermined point.

12. The wear indicator of claim 11 wherein said first refractory material has a first coefficient of thermal expansion and said second refractory material has a second coefficient of thermal expansion, said coefficients of thermal expansion being substantially the same.

13. The wear indicator of claim 12 wherein said second refractory material comprises a dense refractory mix.

14. The wear indicator of claim 13 wherein said refractory mix is selected from the group consisting of silicon carbide, pure magnesite, high alumina, and other non-metallic oxides.

15. A method of making a plug for introducing gas into a mass of molten metal and which will be worn away during use, said plug having a bottom end into which said gas is introduced and a top end from which said gas exits., said method comprising forming a body of a first refractory material so that said body has said top end, said bottom end, and a central longitudinal axis having a bore extending along a portion of said from one of said ends, providing a wear indicator comprising an elongated preformed, self-supporting tube filled with a second refractory material which is visually distinguishable from the refractory material of the body, inserting said wear indicator within said bore adjacent one of said ends so that said wear indicator extends from one of said ends to an intermediate point within said bore, said intermediate point being adjacent the remnant height of said plug.

16. The method of claim 15 wherein said bore is located adjacent said top end of said plug and extends downward therefrom to said intermediate point.

17. The method of claim 15 wherein said bore is located adjacent said bottom end of said plug and extends upward therefrom to intermediate point.

18. The wear indicator of claim 16 wherein said tube is formed of a thermally insulative material.

* * * * *